United States Patent [19]

Okamoto et al.

[11] 4,128,187

[45] Dec. 5, 1978

[54] SECONDARY BARRIER CONSTRUCTION FOR LOW TEMPERATURE LIQUIFIED GAS STORAGE TANK CARRYING VESSELS

[75] Inventors: Tomiyasu Okamoto; Tsunanori Nishimoto; Kaoru Sawada; Koji Hayakawa; Tomomichi Kurihara, all of Osaka, Japan

[73] Assignee: Hitachi Shipbuilding & Engineering Co., Ltd., Osaka, Japan

[21] Appl. No.: 725,979

[22] Filed: Sep. 23, 1976

[30] Foreign Application Priority Data

Oct. 2, 1975 [JP] Japan ..... 50-135606[U]

[51] Int. Cl.[2] ..... B65D 25/18; B65D 7/22; B65D 25/00

[52] U.S. Cl. ..... 220/464; 220/454; 220/901; 114/74 A

[58] Field of Search ..... 220/9 A, 9 LG, 10, 15, 220/454, 464, 901; 114/74 A

[56] References Cited

U.S. PATENT DOCUMENTS

| | | | |
|---|---|---|---|
| 3,112,043 | 11/1963 | Tucker | 220/10 |
| 3,659,543 | 5/1972 | Basile et al. | 220/9 LG X |
| 3,670,917 | 6/1972 | Nishimaki et al. | 220/9 LG X |
| 3,769,118 | 10/1973 | Tariel et al. | 220/9 LG X |
| 3,773,604 | 11/1973 | Desai et al. | 220/9 LG |
| 3,903,824 | 9/1975 | Laverman et al. | 220/9 LG X |
| 4,050,609 | 9/1977 | Okamoto et al. | 220/9 LG |

FOREIGN PATENT DOCUMENTS

| | | | |
|---|---|---|---|
| 860817 | 2/1961 | United Kingdom | 220/9 LG |
| 932581 | 7/1963 | United Kingdom | 220/9 LG |

*Primary Examiner*—William Price
*Assistant Examiner*—Steven M. Pollard
*Attorney, Agent, or Firm*—Joseph W. Farley

[57] ABSTRACT

A heat insulating construction, formed on the hold bottom plates below a spherical tank of a liquified gas carrying vessel, consists of blocks of rigid urethane foam bonded to the hold bottom plates, filling members such as fiber glass inserted into the joints between the rigid foam blocks and adhesively bonded thereto, and a layer of glass mesh and adhesive covering the rigid foam blocks and filling members.

2 Claims, 2 Drawing Figures

SECONDARY BARRIER CONSTRUCTION FOR LOW TEMPERATURE LIQUIFIED GAS STORAGE TANK CARRYING VESSELS

The present invention relates to a secondary barrier construction for low temperature liquified gas storage tank carrying vessels, and more particularly it relates to a secondary wall heat insulating device to be constructed on the hold bottom plate below a spherical tank in a low temperature liquified gas carrying vessel.

In a low temperature liquified gas carrying vessel, it is required to provide a secondary barrier so that if the low temperature liquified gas storage tank is broken to cause the liquified gas to leak, the leakage gas may be temporarily received in order to prevent the ship's hull temperature from becoming lower than an allowable value. In cases where such secondary barrier is constructed of ship's hull members which cannot endure the low temperature of the liquified gas, it is necessary to provide a heat insulating device having sufficient liquid-tightness and pressure resistance to protect the ship's hull members. However, such secondary barrier tends to be so complicated in construction that when it is to be installed on the hold bottom which is narrow, it is desirable to reduce the ship building cost by simplifying the construction.

The main object of the present invention is to provide a secondary barrier construction of simple construction which can be formed very easily. Such secondary barrier construction comprises unit heat insulating block plates adhesively secured to the bottom plate of a ship's hold in which a low temperature liquified gas storage spherical tank is received, heat insulating filling members stuffed into the joints between said block plates, and a protective layer formed on the entire surface of said block plates and of said heat insulating filling members, said unit block plates being in the form of heat insulating members of required thickness preformed into a square or trapezoidal shape, particularly in the form of rigid foam synthetic resin plates.

According to this arrangement of the invention, since unit block plates preformed of a heat insulating material are used, they can be easily transported to the job site and fixed on the hold bottom plate, and hence formation at the job site is very easy, greatly improving the efficiency of working. Further, since a protective layer providing liquid-tightness and pressure resistance is provided on the entire surface, a receiving dish can be obtained having the heat insulation, liquid-tightness and pressure resistance required in the event of leakage of liquified gas. Further, this secondary barrier is also capable of preventing the entry of sea water in the event of a small break caused to the hold bottom plate.

Further, according to a desirable embodiment of the invention, said hold bottom plate is of concave multi-surface construction extending along the lower outer wall surface of a spherical storage tank and has a height up to the tank supporting deck and forms the inner shell of the ship's hull.

Other numerous features and merits of the invention will be readily understood from the following description of a preferred embodiment of the invention with reference to the accompanying drawing.

IN THE DRAWING

Figure 1:
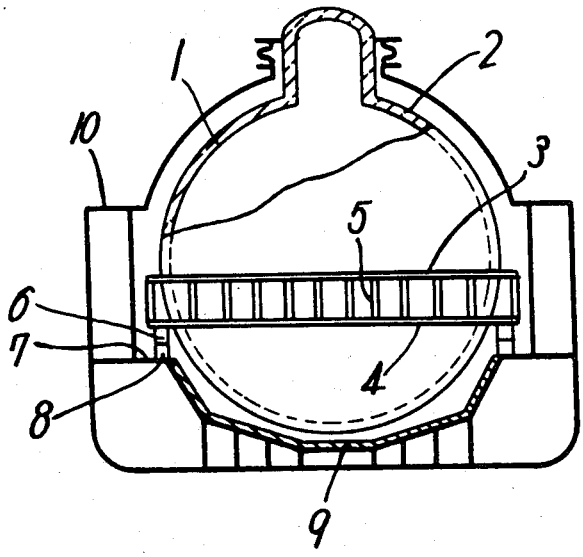
FIG. 1 is a partly broken-away cross-sectional view of a low temperature liquified gas carrying vessel having spherical tanks.

In FIG. 1, the character 1 designates a tank wall; 2, a heat insulating device attached to the surface of the tank wall 1; 3 and 4, upper and lower horizontal support rings horizontally projecting from the tank wall 1 and disposed in the vicinity of the equator of the tank and in a circumferential position spaced therebelow; and 5 are stiffeners interposed between said upper and lower support rings 3 and 4. Designated at 6 are support chocks circumferentially equispaced and fixed to the lower surface of the lower support ring 4, said support chocks being placed on support blocks 8 fixed on a support deck 7, with a suitable pressure-resistant heat insulating material interposed therebetween. Such support arrangement allows the radial expansion and contraction of the tank. The character 9 designates a secondary barrier installed on the hold bottom plate below the tank and 10 designates an upper deck.

Figure 2:
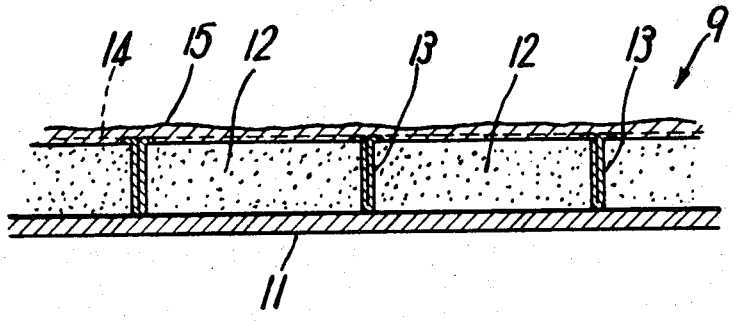
FIG. 2 is a cross-sectional view of a secondary barrier.

FIG. 2 shows the cross-section of the secondary barrier 9, wherein 11 designates the hold bottom plate which is also the inner shell of the hull, which is of concave multi-surface construction extending along the lower portion of the tank wall 1 and having a height up to the support deck 7. Designated at 12 is a block plate made of a rigid foam synthetic resin such as rigid urethane foam, preformed into a square or trapezoidal shape, having a required thickness. Designated at 13 is a heat insulating filling member of single kraft paper-faced fiber glass or the like used for filling the joints between said rigid foam synthetic resin block plates. Instead of such fiber glass, a soft foam synthetic resin such as soft urethane foam may be injected into the joints, or an adhesive agent may be injected. Designated at 14 is fiber glass mesh adhesively applied to the upper surface of the rigid foam synthetic resin block plates 12 and the joints filled with said heat insulating filling members 13, the surface of said glass mesh having an adhesive agent applied thereto several times to form a protective layer.

The order of construction will now be described.

The rigid foam synthetic resin block plates 12 are adhesively secured to the hold bottom plate 11, and fiber glass, for example, serving as the heat insulating filling members 13, is bent with a jig applied to the middle thereof and is inserted between the rigid foam synthetic resin block plates 12 until the bent front end touches the hold bottom plate 11, and the fiber glass is adhesively bonded to the opposed lateral surfaces of the rigid foam synthetic resin block plates 12. Next, an adhesive agent is applied to the upper surface of the rigid foam synthetic resin plates and to the upper surface of the joints filled with the heat insulating members 13, and the glass mesh 14 is applied to the top and an adhesive agent is applied to the surface of the glass mesh 14 several times to form the protective layer 15.

We claim:

1. A secondary barrier construction for a hold plate of a vessel having a hull including a tank supporting deck carrying a spherical low temperature liquified gas storage tank, said hold plate forming the inner shell of the hull and being of concave multi-surface construction and extending adjacent to the lower outer wall surface of the spherical storage tank up to the tank supporting deck;

heat insulating block plates of rigid urethane foam synthetic resin secured to said hold plate with joints between adjacent block plates;

heat insulating filling members placed in said joints and extending to said hold plate, said heat insulating filling members comprising single kraft paper-faced fiber glass folded to form a bent end and a pair of adjacent layers, said bent end extending to said hold plate and said adjacent layers being bonded to the opposed lateral surfaces of said block plates;

and a liquid tight, pressure resistant protective coating formed on the entire outer surface of said block plates and filling members, said protective coating consisting of an adhesive agent applied to the entire outer surface of said block plates and filling members, glass mesh applied to said adhesive agent, and an adhesive layer applied to the top of the glass mesh.

2. A secondary barrier construction as set forth in claim 1, wherein said adhesive layer is formed by plural applications of adhesive agent.

* * * * *